US006212840B1

(12) United States Patent
Davidovitz

(10) Patent No.: US 6,212,840 B1
(45) Date of Patent: Apr. 10, 2001

(54) RETROFIT BLAST PROTECTION FOR WALLS AND WINDOW FRAMES OF A STRUCTURE

(76) Inventor: Fredy Davidovitz, 47 Tel Tzur, Even Yehuda (IL)

( * ) Notice: Subject to any disclaimer, the term of this patent is extended or adjusted under 35 U.S.C. 154(b) by 0 days.

(21) Appl. No.: 09/421,537

(22) Filed: Oct. 20, 1999

(51) Int. Cl.[7] ..... E04B 2/00
(52) U.S. Cl. ..... 52/506.01; 160/327
(58) Field of Search ..... 52/506.01, 506.05, 52/741.3, 745.15, 512, 211, 169.6, DIG. 12; 160/327, 330, 382, DIG. 12

(56) References Cited

U.S. PATENT DOCUMENTS 1,592,408 * 7/1926 Zahner ..... 52/745.15 X
2,956,703 * 10/1960 Royal ..... 156/71
4,018,260 * 4/1977 Baslow ..... 160/327
4,731,972 * 3/1988 Anderson ..... 52/506.01 X
5,617,687 * 4/1997 Bussey, Jr. et al. ..... 52/741.3 X

FOREIGN PATENT DOCUMENTS 6-146306 * 5/1994 (JP) ..... 52/506.01

* cited by examiner

*Primary Examiner*—James O. Hansen
(74) *Attorney, Agent, or Firm*—Mark M. Friedman

(57) ABSTRACT

A retrofit method for protecting the contents of a structure having walls and window frames in the walls in the event of a blast outside the structure. The method is effected by (a) providing a flexible and stretchable woven sheet including strands of ballistic thread; (b) attaching a first portion of the flexible and stretchable woven sheet via a flexible adhesive to an inward-facing surface of at least one wall of the structure; and (c) attaching a second portion of the flexible and stretchable woven sheet to at least one window frame in the at least one wall; the flexible and stretchable woven sheet and the flexible adhesive being capable of stretching under impact of the blast, thereby reducing disintegration of the at least one wall and securing the at least one window frame in the wall upon the blast, preventing fragments from the at least one wall and preventing the at least one window frame from being thrown into an interior of the structure by the blast.

26 Claims, 5 Drawing Sheets

RETROFIT BLAST PROTECTION FOR WALLS AND WINDOW FRAMES OF A STRUCTURE

FIELD AND BACKGROUND OF THE INVENTION

The present invention relates to the protection of the contents of an enclosed space, especially people, against damage caused by flying debris when the walls of the enclosed space are destroyed and the window frames which are no longer secured thereby are ejected inwardly into the interior of the enclosed space.

Bomb blasts are unfortunately a relatively common occurrence, whether in the context of actual warfare or otherwise. Little can be done to prevent damage to persons and objects who suffer a direct hit from the blast.

However, a significant fraction of the persons and property which are hurt or damaged during a bomb blast do not suffer a direct hit and rather are separated from the detonation by a structure. Typically, the persons or objects are inside a house or building while the blast takes place outside the house or building.

It is known that in the case where a blast occurs outside of a structure, some of the damage caused to persons and objects inside the structure are brought about by flying pieces of the walls of the structure as they are broken up and thrust inward by the force of the explosion.

In many cases, a substantial portion of the damage is caused by window frames which are no longer secured by the disintegrating walls of the structure and are forced inwardly by the blast, hurting people and inflicting damage to property. For example, more than 90% of those killed and wounded in the recent blast of the American embassy building in Nairobi were hurt by window frames that were forcibly ejected from the walls and thrown into the rooms of the building, although the window glass in the American embassy in Nairobi were re-enforced with Mylar film coating.

An obvious solution to the problem is to build structures which have strong walls and window frame installations which are capable of withstanding the forces of any expected blast without breaking up. Such walls can be made to be sufficiently strong by increasing the thickness of the wall, reinforcing the wall, or making the wall from a stronger material, carrying blast proof window frames.

Such a solution is not always practicable. Use of blast-proof walls and window frames is expensive and, while certain blast-prone structures may feature such walls and frames, it is not feasible to equip every structure which is the potential target of a bomb blast with such walls and frames.

Retrofit attempts to reinforce existing walls with a reinforcing and protection structure have employed thermosetting adhesive between the reinforcing structure and the wall. Thermosetting adhesives by nature become rigid when cured, thus precluding the very properties of stretch and hold required for the reinforcing structure to perform effectively as a protective shield.

There is thus a widely recognized need for, and it would be highly advantageous to have, a means for protecting the contents of a structure, especially human beings, from harm which may be caused when a blast outside the structure breaks up the walls of the structure and forcibly sends pieces of the walls and the window frames into the structure.

SUMMARY OF THE INVENTION

According to the present invention there is provided a retrofit method for protecting the contents of a structure having walls and window frames in the walls in the event of a blast outside the structure. Further according to the present invention there is provided a structure rendered blast protected by the method of the present invention.

The method according to the present invention comprising the steps of (a) providing a flexible and stretchable woven sheet including strands of ballistic thread; (b) attaching a first portion of the flexible and stretchable woven sheet via a flexible adhesive to an inward-facing surface of at least one wall of the structure; and (c) attaching a second portion of the flexible and stretchable woven sheet to at least one window frame in the at least one wall; the flexible and stretchable woven sheet and the flexible adhesive being capable of stretching under impact of the blast, thereby reducing disintegration of the at least one wall and securing the at least one window frame in the wall upon the blast, preventing fragments from the at least one wall and preventing the at least one window frame from being thrown into an interior of the structure by the blast.

Accordingly, the present invention provides a blast protected structure comprising a wall having a window frame therein, an inward facing surface of the wall being covered by a first portion of a flexible and stretchable woven sheet, being attached thereto and including strands of ballistic thread, the window frame being covered by a second portion of the flexible and stretchable woven sheet being attached thereto, such that, in the event of a blast outside the structure, the flexible and stretchable woven sheet being capable of stretching under impact of the blast, thereby reducing disintegration of the wall and securing the window frame in the wall, preventing fragments from the wall and preventing the window frame from being thrown into an interior of the structure by the blast.

According to further features in preferred embodiments of the invention described below, the flexible and stretchable woven sheet has two surfaces, one of the surfaces serves for direct permanent attachment with the flexible adhesive to the inward-facing surface of the at least one wall while the other of the surfaces directly faces the contents of the structure.

According to still further features in the described preferred embodiments the strands of ballistic thread are surrounded by a sheath for facilitating attachment to the inward-facing surface of the at least one wall.

According to still further features in the described preferred embodiments the flexible adhesive comprises a thermoplastic and elastic material.

According to still further features in the described preferred embodiments the ballistic thread is a para aramid.

According to still further features in the described preferred embodiments the ballistic thread is Kevlar® (made by DuPont).

According to still further features in the described preferred embodiments the ballistic thread is Spectra® (made by Allied Chemical).

According to still further features in the described preferred embodiments the ballistic thread is Dyneema®.

According to still further features in the described preferred embodiments the sheath includes a natural fiber.

According to still further features in the described preferred embodiments the sheath includes cotton.

According to still further features in the described preferred embodiments the strands include a retaining thread.

According to still further features in the described preferred embodiments the retaining thread is coiled around the sheath.

According to still further features in the described preferred embodiments the step of attaching a second portion of the flexible and stretchable woven sheet to at least one window frame in the at least one wall is effected by (i) turning over at least one peripheral portion of the flexible and stretchable woven sheet so as to form at least one folded edge; (ii) positioning a thickening device in the at least one folded edge; (iii) attaching the at least one folded edge to the at least one window frame via a mechanical attachment, such that the thickening device prevents disengagement of the flexible and stretchable woven sheet from the mechanical attachment.

According to still further features in the described preferred embodiments the mechanical attachment includes a bar securable to the window frame.

The present invention is of a means for preventing blast damage inside structures when the blast occurs outside the structure. This result is accomplished by attaching, as by use of adhesives and mechanical means, to inward-facing walls of the structure and to the window frames thereof woven sheets of material which contains ballistic thread. The ballistic thread may be wrapped or surrounded by a second material which can be readily attached to the wall.

In the event of a blast outside the structure, the walls of the structure may break down producing many dangerous pieces which would normally be thrust along with the window frames which are no longer secured by the walls, inward toward the interior of the structure, incurring considerable damage to persons and property located in the interior of the structure.

However, the presence of the woven sheet on the inward-facing walls and the window frames serves to immediately stop the motion of these pieces and prevents them from flying into the interior spaces. It will be appreciated in this respect, and it was also experimentally determined that attaching the sheet only to the walls, while not attaching the sheet to the window frames as well, results in the ejection of the window frames inwardly towards the interior of the structure upon a blast.

The present invention successfully addresses the shortcomings of the presently known configurations by providing a woven sheet which can be quickly and inexpensively attached to normal inward-facing walls and window frames of a structure and which will considerably reduce damage to persons and property in the structure from a blast occurring outside the structure.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
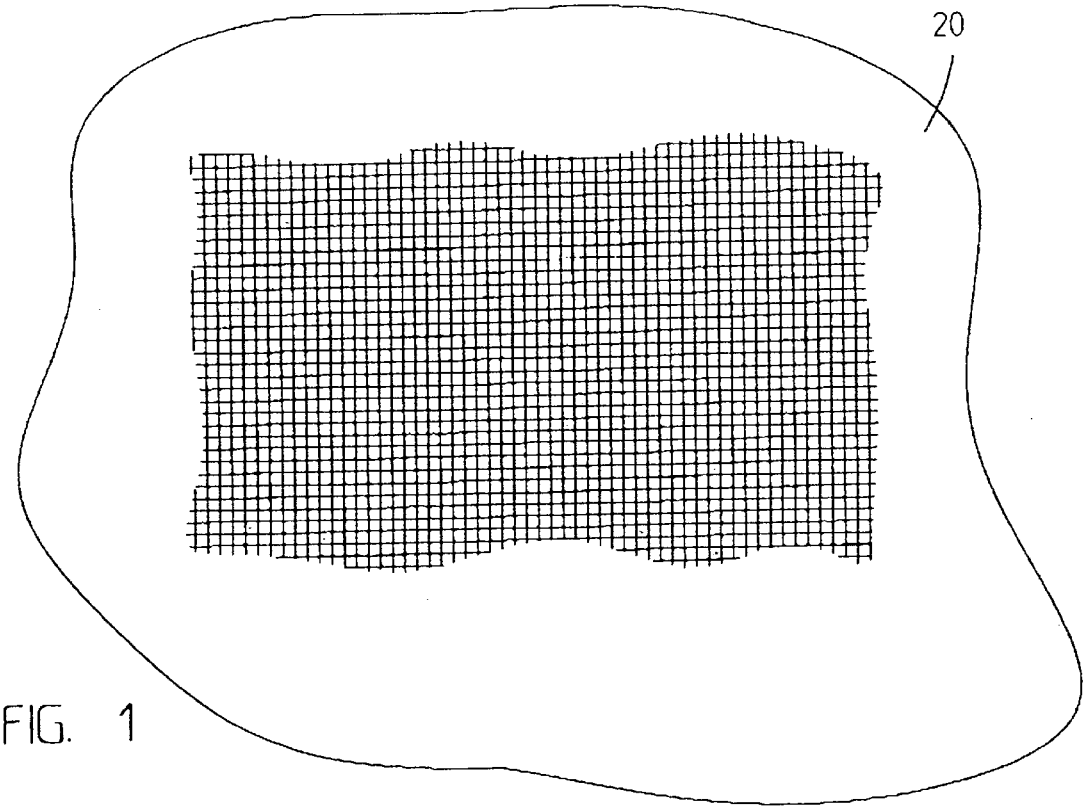
FIG. 1 is a plan view of a portion of a woven sheet and a wall to which the sheet is attached according to the present invention.

The present invention is of a method of protecting the contents of a structure from the effects of a blast taking place outside the structure through the attachment of protective wall covering to the inward-facing surface of the walls and the window frames of the structure. The present invention is further of a structure protected by the method of the present invention.

As used throughout, the term "structure" refers to at least one wall having at least one window frame engaged therein. Typically, a structure includes a plurality of walls which form one or more enclosed space.

The principles and operation of a wall covering and method of protection according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 illustrates a portion of a woven sheet used to implement the method according to the present invention. The woven sheet may be made by any suitable weaving machine and may come in various weights and sizes.

The woven sheet is made of any suitable materials, provided that the sheet includes sufficiently high strength thread so as to give the sheet the ability to hold broken wall fragments and window frames in place when the wall is exposed to a blast taking place at the back surface of the wall. For convenience, such a thread is termed throughout a ballistic thread.

The ballistic thread used may be any of a number of suitable materials, including various nylons and polyethylenes. Preferably the ballistic thread is a para aramid such as Kevlar®, Spectra® or Dyneema®, most preferably about 1000 Denier Kevlar®, about 650 Denier Spectra® or about 650 Denier Dyneema®. Typical ballistic threads are UV sensitive and will deteriorate if exposed for prolonged periods to sunlight. In addition, typical ballistic threads are difficult to paint and do not readily respond to ordinarily available adhesives.

Figure 2:
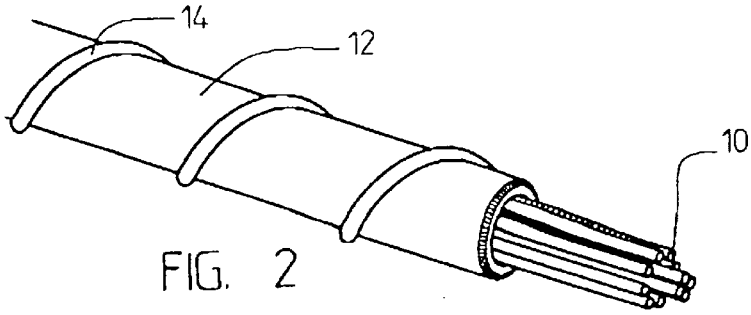
FIG. 2 is a close up view of one end of a single strand, such as might be used to form the woven sheet of FIG. 1.

For these reasons, it is preferable to surround the ballistic thread with a second material which will protect the ballistic fiber from UV light and which will readily adhere to walls and to paint. An example of such a structure is shown in FIG. 2 which shows one end of a single strand which can be used to make up the woven sheet 22 of FIG. 1.

The strand includes a core 10 of ballistic thread and a sheath 12 surrounding core 10 which is made up of a second material. The material making up sheath 12 should be a material which can readily and firmly attach to a wall 20. The precise identity of the material making up sheath 12 depends on the type of wall surface to be covered and on the available adhesive. Preferably, sheath 12 is also readily paintable and gives an aesthetically pleasing texture.

For typical brick, wood or sheetrock walls it is preferable to use a natural fiber, most preferably cotton (Vistra®), as the sheath material.

To prevent sheath 12 from loosening during weaving and potentially impeding the weaving operation, it is preferable to include a retaining thread 14 which is coiled around sheath 12 so as to keep sheath 12 together. Preferably, retaining thread 14 is made of a material, typically the same material as sheath 12, which can easily attach to wall 20 and which can be readily painted.

Strands as shown in FIG. 2 can be used to create a woven sheet using any suitable weaving machine. Any suitable core weaving machine, such as the Fhrer machine (Austria) may be used to prepare the strand and then immediately weave it into sheets.

The relative amounts of sheath material and ballistic thread used will depend on the application. The resulting woven sheet may have any suitable weight. For example, the sheet can be 550 gm/m$^2$ (approximate Ne of 3) or up to about 700 gm/m$^2$ (approximate Ne of 2.2 to 2.3). Preferably the weave style is Half (½) Panama.

Attachment of portions of woven sheets according to the present invention to a wall can take through use of any suitable thermoplastic flexible adhesive, for example, the type of contact adhesives ordinarily used for gluing wallpaper to the wall. The choice of employing a proper stretchable and flexible adhesive is essential and required for the effective utilization of the flexible fabric of the instant invention. Thermoplastic adhesives allow the woven sheets to stretch when subject to a blast in that they have a rubber type flexibility and rate of elongation (stretchability) to enable the ballistic wall covering to perform in prevention of wall disintegration in the manner intended in the instant invention.

Thermoplastic adhesive are classified under the general category of thermoplastic resins and thermoplastic rubber adhesives. The type of synthetic materials that makes up this category are typified by acrylic and vinyl polymers, cellulose derivatives, natural products such as rubber, synthetic rubber, resin, oleo resins and mineral waxes. One specific adhesive that can be employed in the instant invention, though it is to be understood that this adhesive should not be considered limiting in any way, is a commercially available acrylic adhesive based on acrylates, in emulsion form, identified as Silex, manufactured by Nirlat, Ltd., of Kibbutz Nir-Or, Israel, under Product Code Number 34022197. It should be noted that other types of thermoplastic resin or thermoplastic rubber based adhesives can be used and applied to wall and ballistic wall covering fabrics with the same successful end results.

The process of installing portions of woven sheets according to the present invention to walls is not unlike that of installing wallpaper. The wall is prepared so as to maximize the holding power of the adhesive. The thermoplastic adhesive is then placed on the wall (or on the back side of the woven sheets). The sheets are then placed on the wall and pressed. Installation to the wall is complete once the adhesive is dry.

An important feature of the present invention is the attachment of other portions of the woven sheets to window frames, so as to prevent the ejection of such frames inwardly into the interior of the structure upon a blast. This feature of the present invention will now be illustrated in detail in context with FIGS. 3–4.

Figure 3:
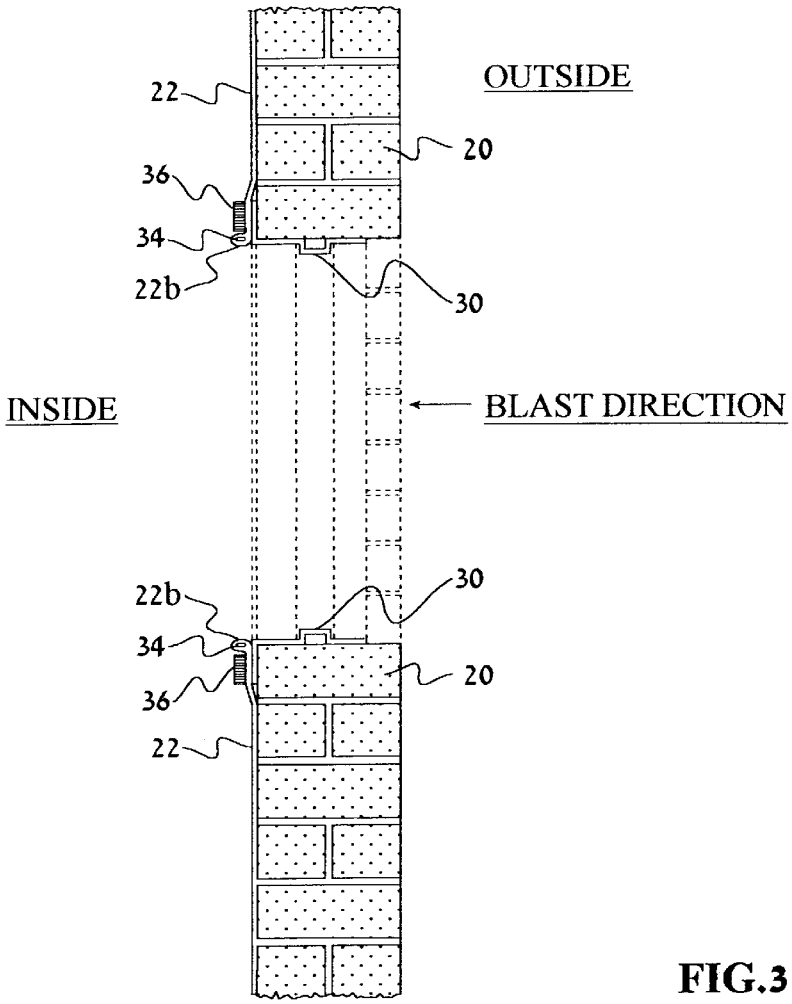
FIGS. 3–4 show a preferred mode of attachment of a portion of the woven sheet to a window frame according to the present invention.
Figure 4:
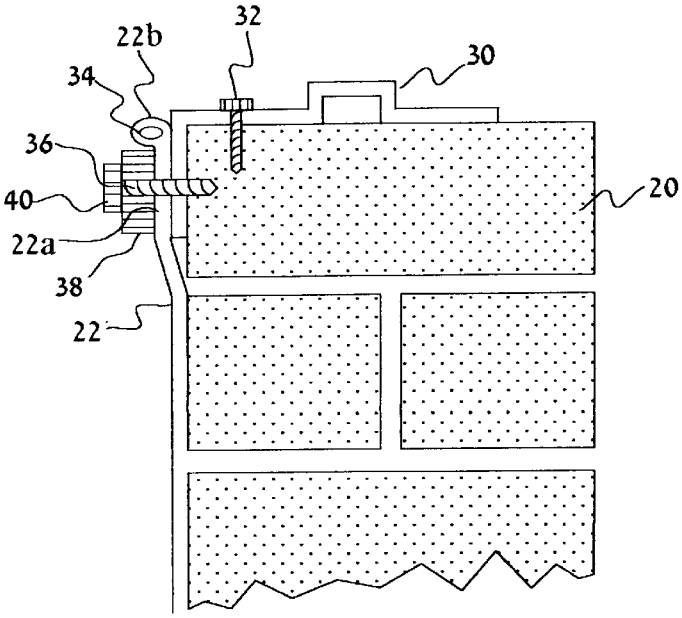

Thus, as shown in FIGS. 3–4, a window frame 30 which is typically engaged in wall 20 and is typically secured thereto via a screw 32 is at least partially covered by a peripheral portion 22*a* of woven sheet 22 attached thereto. After cutting sheet 20 to the appropriate size and creating an opening or recession therein, peripheral portion 22*a* of woven sheet 22 is folded or turned in so as to form a folded edge 22*b*. A thickening device 34, such as a rope in the folded edge, so as to provide sheet 22 with a thick edge. Folded edge 22*a* is thereafter attached to window frame 30 via a mechanical attachment 36 such that thickening device 34 prevents disengagement of woven sheet 22 from mechanical attachment 36.

According to a preferred embodiment of the present invention mechanical attachment 36 includes a bar 38, typically a galvanized steel bar, securable to window frame 30 via screws 40 which are preferably selected long enough so as to engage to a portion of wall 20 supporting frame 30.

Figure 5:
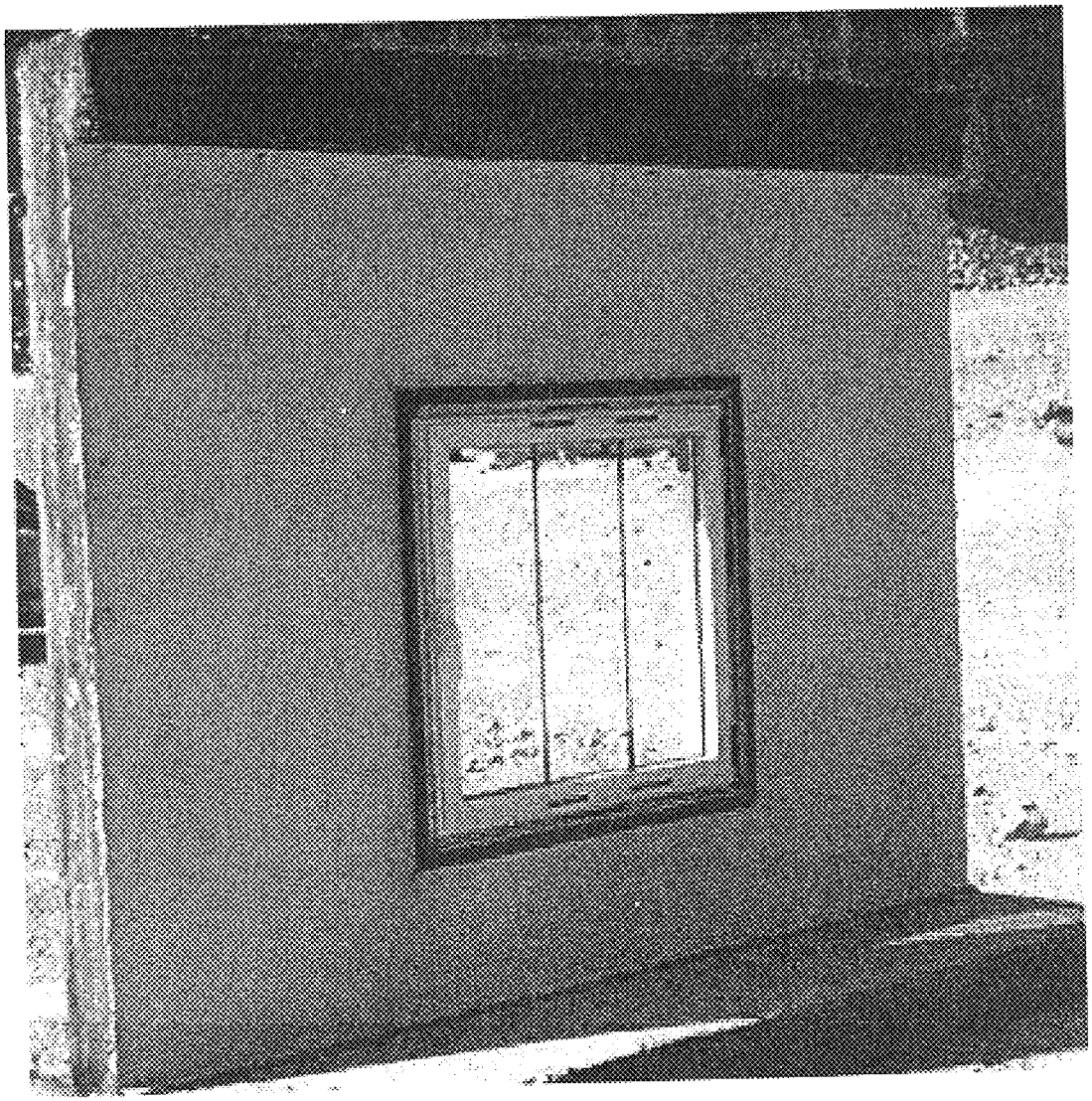
FIGS. 5–7 are photographs of a window frame engaging an intensified glass plate and being secured to a test masonry wall by a woven sheet of ballistic thread according to the teachings of the present invention prior to a blast (FIG. 5) and following a blast of 65 PSI at impulse of 70 PSI per millisecond (FIGS. 6 and 7), note that the window frame did not eject from the wall.
Figure 6:
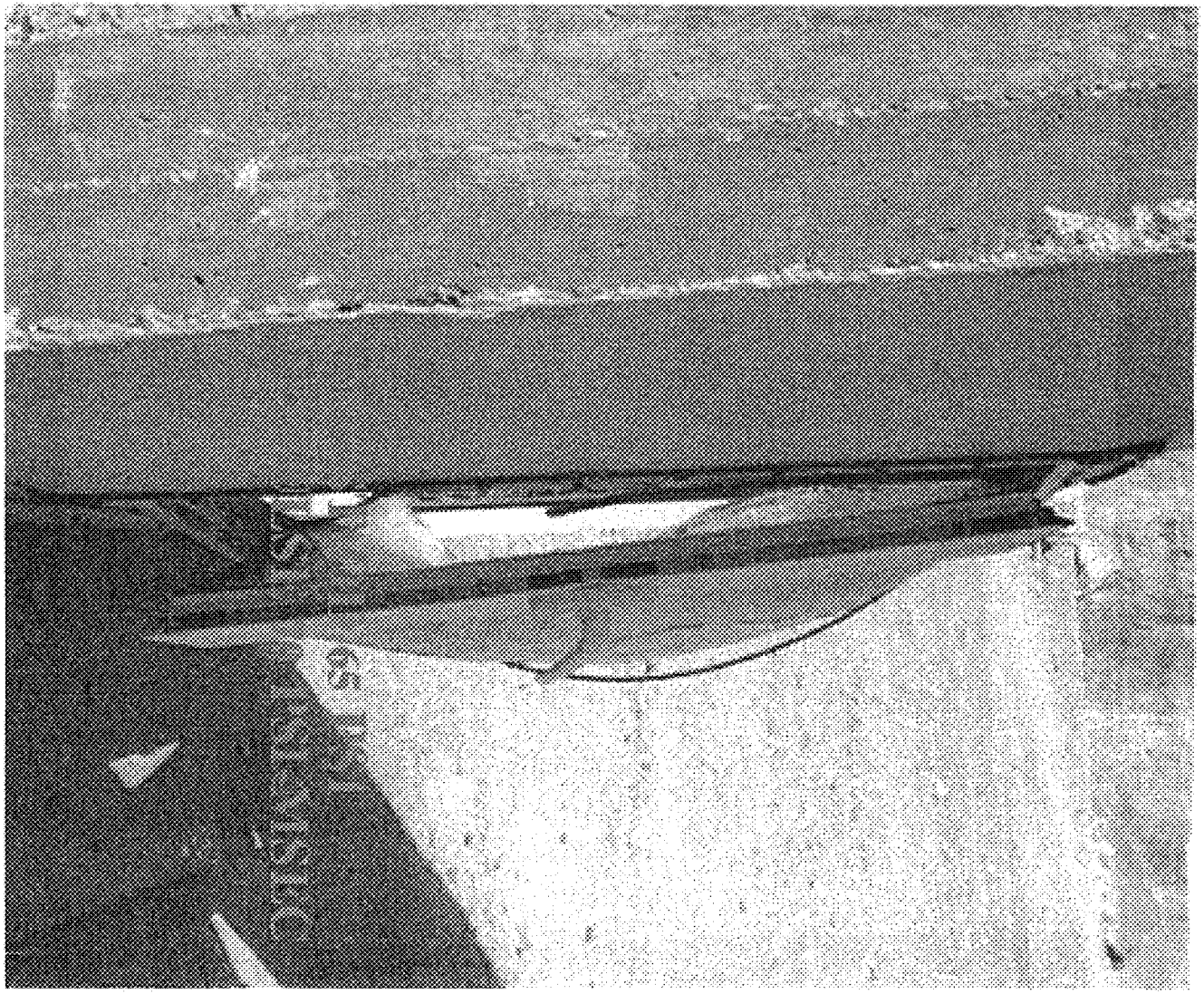
Figure 7:
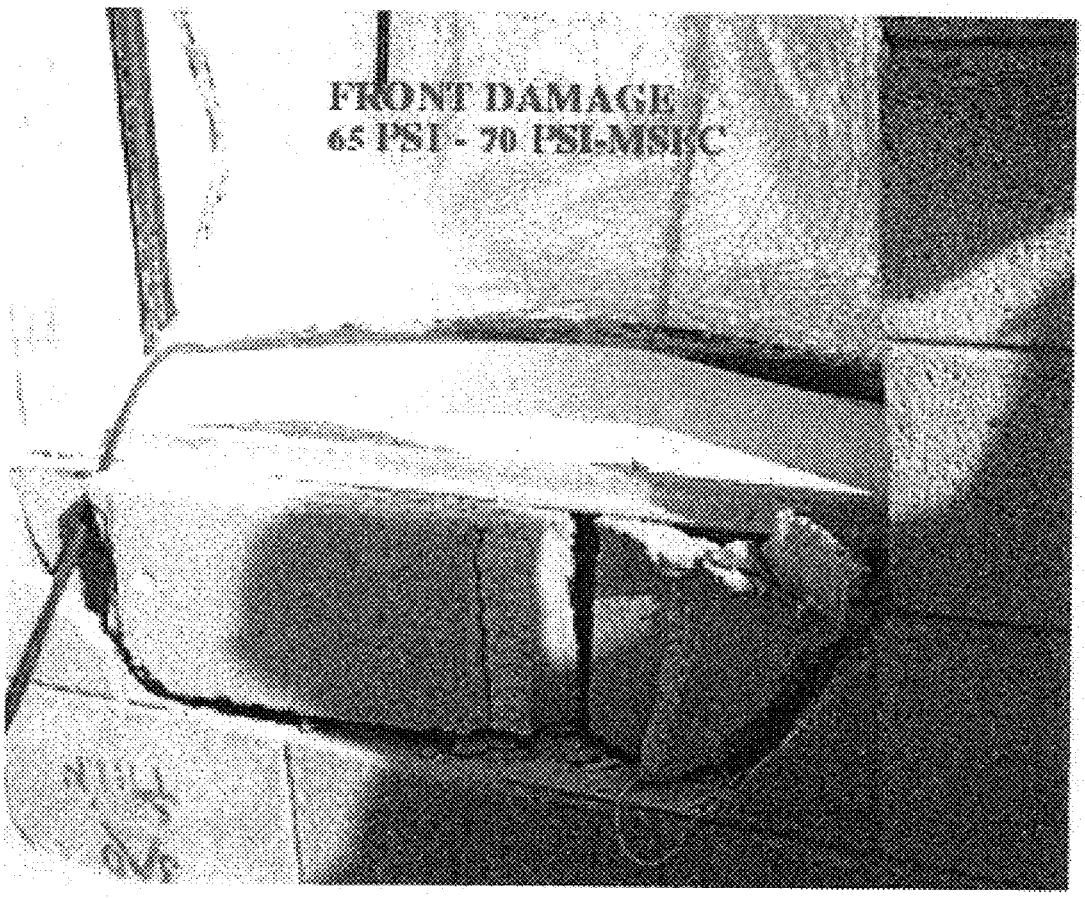

As shown in FIGS. 5–7, it was experimentally shown that the use of a thickening device in combination with a bar as herein described ensures that upon a blast outside the structure the window frame does not eject from the wall. It was, however, also experimentally shown that restricting the coverage of the woven sheet to the wall itself, while failing to also cover the window frame of the wall, results in ejection of the window frame from the wall upon a blast.

Thus, attaching a portion of the flexible and stretchable woven sheet to a window frame in a wall reduces disintegration of the wall and secures the window frame in the wall upon a blast, preventing fragments from the wall and preventing the window frame from being thrown into the interior of a structure.

Following installation as herein described, the exposed side of the woven sheets may be painted or otherwise treated to enhance its aesthetic value. Alternatively, the woven sheets may be left in their original state, giving the walls an aesthetically pleasing woven fabric look.

Thus, there has been described a ballistic wall covering that, being adhered to a wall with a flexible thermoplastic adhesive that does not rigidify the wall covering, and further being attached to a window frame in the wall, after the explosive blast and after-shock waves have damaged the building structure, the applied ballistic wall covering stretches under the impact of the blast, distributing the stress caused and prevents the concrete and brick fragments, as well as the window frame, from being thrown into the building interior, thus shielding and greatly reducing the amount of injury caused to personnel within the structure.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A retrofit method for protecting contents of a structure having walls and window frames in said walls in the event of a blast outside the structure, the method comprising the steps of:

(a) providing a flexible and stretchable woven sheet including strands of ballistic thread;

(b) substantially contacting and bonding a first portion of said flexible and stretchable woven sheet via a flexible adhesive to an inward-facing surface of at least one wall of the structure; and (c) attaching a second portion of said flexible and stretchable woven sheet to at least one window frame in said at least one wall;

such that, under impact of said blast, said flexible and stretchable woven sheet and said flexible adhesive absorb impact by stretching, thereby reducing disintegration of said at least one wall and securing said at least one window frame in said wall upon said blast, preventing fragments from said at least one wall and preventing said at least one window frame from being thrown into an interior of the structure by said blast.

2. The method of claim 1, wherein said flexible and stretchable woven sheet has two surfaces, and wherein one of said surfaces serves for direct permanent attachment with said flexible adhesive to said inward-facing surface of said at least one wall while the other of said surfaces directly faces the contents of the structure.

3. The method of claim 1, wherein said strands of ballistic thread are surrounded by a sheath for facilitating attachment to said inward-facing surface of said at least one wall.

4. The method of claim 3, wherein said sheath includes a natural fiber.

5. The method of claim 4, wherein said sheath includes cotton.

6. The method of claim 3, wherein said strands include a retaining thread.

7. The method of claim 6, wherein said retaining thread is coiled around said sheath.

8. The method of claim 1, wherein said flexible adhesive comprises a thermoplastic and elastic material.

9. The method of claim 1, wherein said ballistic thread is a para aramid.

10. The method of claim 1, wherein said step of attaching a second portion of said flexible and stretchable woven sheet to said at least one window frame in said at least one wall is effected by:

(i) turning over at least one peripheral portion of said flexible and stretchable woven sheet so as to form at least one folded edge;

(ii) positioning a thickening device in said at least one folded edge;

(iii) directly attaching said at least one folded edge to said at least one window frame via a mechanical attachment, such that said thickening device prevents disengagement of said flexible and stretchable woven sheet from said mechanical attachment.

11. The method of claim 10, wherein said mechanical attachment includes a bar securable to the window frame.

12. The method of claim 10, wherein said mechanical attachment includes a bar securable to the window frame by at least one element engaging said at least one wall.

13. The method of claim 12, wherein said at least one element includes a screw.

14. A blast protected structure comprising a wall having a window frame therein, a flexible and stretchable woven sheet having strands of ballistic thread, and a flexible adhesive, wherein a first portion of said flexible and stretchable woven sheet is substantially contacted and bonded to an inward facing surface of said wall by means of said flexible adhesive, and wherein a second portion of said flexible and stretchable woven sheet at least partially covers said window frame, said sheet being directly attached thereto, such that, under impact of a blast outside the structure, said flexible and stretchable woven sheet and said flexible adhesive absorb impact by stretching, thereby reducing disintegration of said wall and securing said window frame in said wall, preventing fragments from said wall and preventing said window frame from being thrown into an interior of the structure by said blast.

15. The structure of claim 14, wherein said flexible and stretchable woven sheet has two surfaces, and wherein one of said surfaces serves for direct permanent attachment with a flexible adhesive to said inward-facing surface of said wall while the other of said surfaces directly faces the contents of the structure.

16. The structure of claim 15, wherein said flexible adhesive comprises a thermoplastic and elastic material.

17. The structure of claim 14, wherein said strands of ballistic thread are surrounded by a sheath for facilitating attachment to said inward-facing surface of said wall.

18. The structure of claim 17, wherein said sheath includes a natural fiber.

19. The structure of claim 18, wherein said sheath includes cotton.

20. The structure of claim 17, wherein said strands include a retaining thread.

21. The structure of claim 20, wherein said retaining thread is coiled around said sheath.

22. The structure of claim 14, wherein said ballistic thread is a para aramid.

23. The structure of claim 14, wherein said second portion of said flexible and stretchable woven sheet further comprises a folded edge formed at a peripheral portion of said flexible and stretchable woven sheet, and wherein the structure further comprises a thickening device disposed in said folded edge and a mechanical attachment, such that said thickening device prevents disengagement of said flexible and stretchable woven sheet from said mechanical attachment.

24. The structure of claim 23, wherein said mechanical attachment includes a bar securable to said window frame.

25. The structure of claim 24, said bar being securable to said window frame by at least one element engaging said wall.

26. The structure of claim 25, wherein said at least one element includes a screw.

* * * * *